United States Patent [19]

Belitsin et al.

[11] 4,179,259

[45] Dec. 18, 1979

[54] SPINNERET FOR THE PRODUCTION OF WOOL-LIKE MAN-MADE FILAMENT

[76] Inventors: Mikhail N. Belitsin, 2 Donskoi proezd, 6, kv. 9, Moscow; Sergei A. Kudryashov, ulitsa Mira, 16, kv. 33, Klin Moskovskoi oblasti; Alexandr G. Borik, Borodinsky prospekt, 7, kv. 27, Klin Moskovskoi oblasti; Valentin V. Kulikov, Leningradskoe shosse, 44, kv. 58, Klin Moskovskoi oblasti; Natalia A. Sadkova, ulitsa Oxkaya, 22/2, kv. 13, Moscow; Galina A. Kudryashova, ulitsa Mira, 16, kv. 33; Leonid F. Vorontsov, ulitsa Gagarina, 45, kv. 8, both of Klin Moskovskoi oblasti, all of U.S.S.R.

[21] Appl. No.: 835,221

[22] Filed: Sep. 20, 1977

[51] Int. Cl.[2] ..... D01D 3/00

[52] U.S. Cl. ..... 425/461; 425/464

[58] Field of Search ..... 425/461, 464

[56] References Cited

FOREIGN PATENT DOCUMENTS

| | | | |
|---|---|---|---|
| 6709531 | 1/1968 | Netherlands | 425/464 |
| 286130 | 1/1971 | U.S.S.R. | 425/464 |

*Primary Examiner*—Robert D. Baldwin
*Assistant Examiner*—J. Reed Batten, Jr.
*Attorney, Agent, or Firm*—Steinberg and Blake

[57] ABSTRACT

The present invention relates to production of wool-like chemical filaments and, more particularly, to a spinneret for obtaining these filaments. The present invention is most effectively realized in the production from these filaments of household and industrial textiles. This spinneret includes a filament-forming hole made as a slot with a configuration of an open polygon, having a rectilinear portion adjoining one of the sides thereof and one more element shaped as a rectilinear section adjoining this portion at a right angle thereto. Such a structure of the spinneret permits production of a wool-like filament possessing all properties inherent in natural wool, namely, low heat conductivity, permanent crimp, and high hygienic properties.

7 Claims, 15 Drawing Figures

SPINNERET FOR THE PRODUCTION OF WOOL-LIKE MAN-MADE FILAMENT

FIELD OF THE INVENTION

The present invention relates to production of physically modified wool-like chemical filaments and textile products made therefrom and may be employed in all branches of the textile industry involved in the manufacture of woolen goods.

The invention can be most advantageously used in the production of various household and industrial goods in the textile, knitting and other industries.

Physical modification in this case implies changes in the cross-sectional shape of the filament or fibre attained through changes in the shape of the filament-forming holes in the spinneret.

Physical modification makes it possible to improve the physical, geometrical, physicochemical properties of the yarns and fibres. Besides, it enables the performance and appearance of goods made from these filaments to be enhanced.

The acute shortage of natural fibres as well as the steadily growing demands for comfort properties of textiles have given rise to wool-, silk-, cotton- and flax-like fibres, yarns and goods made therefrom.

Wool-like man-made fibres and yarns may be obtained by providing them with an elaborate coss-sectional configuration and by formation of an inner cavity due to spinning through a spinneret with a profiled filament-forming hole as well as by imparting crimp to a filament or fibre.

BACKGROUND OF THE INVENTION

At present there are known yarns obtained from ordinary spinnerets and featuring crimp necessary for wool-like fibres and filaments. The crimp is attainable either through the use of two or more components in the filamentary yarn with different shrinking and swelling properties or through asymmetric cooling thereof in a direction normal to its movement.

The known methods of imparting crimp to the filament are rather complicated since they call for special auxiliary contrivances.

There are also known spinnerets with a non-round configuration of the filament-forming holes which make it possible to produce hollow wool-like fibres and filaments with a non-round cross-section featuring certain wool-like properties: low heat conductivity, increased mechanical cohesion of individual fibres, bulk and opticl properties.

For instance, according to USSR Inventor's Certificate No. 286,130, there is known a spinneret for forming chemical hollow wool-like fibres, having a spinning hole made as a slot with a configuration of an open polygon provided with three branches, each being arranged at a right angle to one of the sides of the polygon.

Fibres formed by extrusion through the hole of the known configuration approximate, as to heat conductivity, volume weight and cohesion, natural wool, but the most essential characteristics determining their hygienic properties (capillarity, moisture conductivity) practically do not change. Moreover, fibres spun through the spinneret according to USSR Inventor's Certificate No. 286,130 lack crimp required for wool limitation. The mechanical crimp of the filament rapidly disappears during processing and in use. Therefore, these fibres are used, mainly, as additives to natural wool, their amount in the mixture not exceeding 30 percent. Thus, all chemical fibres and yarns known in the art do not exhibit all the properties inherent in natural wool, such as low heat conductivity, permanent crimp, adequate moisture conductivity, moisture capacity, and bulk.

BRIEF DESCRIPTION OF THE INVENTION

It is an object of the present invention to provide a spinneret for producing a chemical filament, having a spinning hole of such a configuration which will enable obtaining a filament exhibiting all properties inherent in natural wool, namely, low heat conductivity, permanent crimp, high hygienic properties (moisture absorption, capillarity, moisture desorption).

This and other objects are attained by forming a filament through a spinneret wherein a spinning hole is made as a slot having a configuration of an open polygon with a rectilinear portion adjoining, at a right angle at least one of the sides thereof, in which spinneret, in accordance with the invention, the configuration of the slot-shaped hole has at least one more element arranged at a right angle to the rectilinear portion.

The proposed configuration of the filament-forming hole makes it possible to produce a filament with a cross-section composed of two elements, one of the elements being formed by rectilinear branches the mutual arrangement whereof renders the elements L-shaped, T-shaped, cross-shaped or fork-shaped, and the other element having the form of a ring. Such a cross-sectional shape of the filament permits forming therein open capillary channels communicating with the outer surface of the fibre over its entire length. These capillary channels are formed in the open element of the filament cross-section. The presence of the capillary channels increases the moisture conductivity of the filament, capillarity, moisture capacity ensuring adequate hygienic properties of articles made from these filaments. The open polygon allows obtaining a cavity in the filament due to which low heat conductivity is provided. With such a configuration of the filament cross-section, said elements, by virtue of their different specific surface (per unit of dope mass), are cooled at different rates. Cooling of the element with the inner cavity is slower. This is determined by the presence of air (thermally nonconductive medium) therein and also by said element being shaped as a ring whereby the cooling takes place from the outer surface thereof.

At the same time, the element of the open polygon composed of rectilinear branches is cooled from both the outer and inner surfaces. Therefore, its cooling is faster.

As a result of this non-uniform cooling, a permanent crimp is developed in the filament similar to that of natural wool. In addition, the L-shaped, T-shaped, fork-shaped and cross-shaped branches ensure high bulk and cohesion of the filament.

Thus, as distinct from the wool-like chemical yarns known in the art, the filament obtained on the proposed spinneret exhibits all essential properties inherent in natural wool, namely, permanent crimp, low heat conductivity, high moisture conductivity, as well as high bulk and cohesion.

According to an alternative embodiment of the invention, the element of the configuration of the filament-forming hole in the spinneret, arranged at a right angle to the rectilinear portion, may have the shape of a rectilinear section.

As a result of formation of the filament through the spinneret with said configuration of the filament-forming hole, there is obtained a filament having a cross-section composed of two elements, one of which is either L-shaped or T-shaped and the other has the shape of a ring. Such a configuration of the cross-section, having two elements differing in shape makes it possible to obtain in the filament permanent crimp due to said elements of the filament being non-uniformly cooled. At the same time, the L-shaped or T-shaped element, together with the ring-shaped element, permit forming in the filament one or two equal and sufficiently deep oven capillary channels communicating with the outer surface of the filament.

The presence of one or two sufficiently deep open capillary channels provides for adequate sorption properties of the filament (increased capillarity, moisture desorption), approximating those of the natural wool.

At the same time, the inner cavity in the filament running along its entire length, formed by the open poygon makes it possible to impart low heat conductivity to the filament.

Moreover, the L-shaped or T-shaped element adds to the bulk and cohesion of the filament.

According to another embodiment of the invention, the element of the configuration of the filament-forming hole, made as a rectilinear section intersects the rectilinear portion. In this case, one end of the rectilinear portion adjoins the side of the polygon, the other end being free.

As a result of formation of the filament through the spinneret with the filament-forming hole of said configuration, there may be obtained a filament having a cross-section composed of two elements, one of which is cross-shaped and the other has the shape of a ring. Such a configuration of the cross-section ensures formation of two deep open capillary channels providing for adequate sorption properties of the filament, low heat conductivity and permanent crimp.

Besides, the free end of the rectilinear portion in the configuration of the cross-section of the filament allows imparting to the filamentary yarn composed of filaments of said cross-sectional shape increased bulk due to greater interfilament spacing.

According to still another embodiment of the invention, adjoining the rectilinear section intersecting the rectilinear portion at a right angle to this piece and as close as possible to the ends thereof are two rectilinear portions. Also, according to the invention, these rectilinear portions are directed aside from the polygon, thereby forming an element shaped as a three-pronged fork.

As a result of formation of the filament through the spinneret with such a filament-forming hole, there is produced a filament with a cross-section composed of two elements. One of these elements has the form of a three-pronged fork and the other, the form of a ring. The presence in the configuration of the filament cross-section of the element shaped as a three-pronged fork enables increasing the moisture conductivity and capillarity of the filament due to the greater number of capillary channels, i.e. due to the formation of two additional deep open capillary channels (four in number). Moreover, the presence of the element shaped as a three-pronged fork further increases the bulk of the filamentary yarn composed of filaments with such a configuration of the cross-section, because of the still greater interfilament spacing.

According to yet another embodiment of the invention, the element shaped as a three-pronged fork adjoins one of the vertices of the open polygon with its rectilinear portion; one more rectilinear portion may emerge from the same vertex at a right angle to the latter.

As a result of formation of the filament through such a filament-forming hole of the spinneret, there is produced a filament with the configuration of its cross-section being composed of the following elements: an element shaped as a three-pronged fork, an additional branch formed by the additional rectilinear portion emerging from the polygon vertex, and a ring-shaped element. This being the case, as distinct from the above cross-sections of the filament, the size of the ring-shaped element is approximately two times smaller. Moreover, the ring-shaped element is located in the right upper corner relative to the axis of symmetry of the cross-section of the filament, whereas the three-pronged element forms, together with the additional rectilinear branch, four deep open capillary channels. Besides, a less deep capillary channel is formed intermediate of the additional branch and the ring-shaped element. Due to this capillary channel, the sorption properties of the filament are improved. Due to a smaller size of the cavity and due to its circumferential arrangement with respect to the axis of symmetry of the cross-section, the cooling conditions of the filament are changed and fine crimp of the filament is attained, which is desirable for the production of a filamentary yarn of low linear density required for producing light fabrics used in hot and humid climates.

According to one more embodiment of the invention, adjoining said additional rectilinear portion emerging from the vertex of the polygon at a right angle thereto may be one more rectilinear portion whose free end is adjoined, in turn, by one more rectilinear portion directed towards the polygon, whereby an additional open polygon is formed. As a result of formation of the filament through such a hole in the spinneret, two open polygons form two cavities in the filament, whereas the three-pronged element forms in the filament four deep open capillary channels. The resulting filament exhibits higher stiffness and resilience and may be used in the production of pile fabrics with pile resistant to mechanical action.

According to still another embodiment of the invention, the part of the rectilinear portion through which the three-pronged fork adjoins the polygon and which is disposed intermediate of the fork and the polygon is, at least in the central part, intersected by one more rectilinear portion at a right angle.

As a result of formation of the filament through such a hole with two open polygons, formed in the filament are two approximately equal inner cavities, whereas due to the additional rectilinear portion formed in the configuration of the cross-section of the filament are two additional rectilinear branches ensuring, together with the three-pronged element, formation in the filament of six deep open capillary channels communicating, over the entire length of the filament, with the outer surface thereof. The additional rectilinear branches in the cross-section of the filament equalize the masses of two portions of the cross-section: the portion composed of the three-pronged element and additional rectilinear branches and the portion composed of two ring-shaped elements. This somehow reduces the filament crimp.

However, due to the increased number of open capillary channel, the sorption properties are significantly enhanced. This provides for adequate ventilation of the space between the human body and the garment.

Also, according to the invention, emerging from the vertex of the open polygon in the configuration of the thread-forming hole may be simultaneously a rectilinear portion and an element shaped as a two-pronged fork formed by said rectilinear portions, at least the mid-portion of the rectilinear section of the two-pronged fork, disposed intermediate of the prongs and the vertex of the polygon, being intersected at a right angle by another rectilinear portion.

As a result of formation of the filament through such a hole, there is produced a filament with a cavity arranged circumferentially with respect to the filament axis. The two-pronged element of the cross-section of the filament and the rectilinear portions form five deep and one less deep open capillary channels communicating with the outer surface of the filament over its entire length. Due to the plurality of capillary channels and also due to a small cavity, this filament possesses high sorption properties and fine crimp and may be used in light fabrics and knitwear suitable for hot and humid climates.

In accordance with the invention, the filament yarn composed of filaments formed on the spinneret with said configurations of the filament-forming holes features a twist ranging from 10 to 1,500 T.P.M. Said twist is imparted to the filament yarn with the aim of improving its wool-like properties (moisture conductivity and resilience). A lower twist could decrease the angle of inclination of the capillaries with respect to the outer surface of the filament and impair the sorption properties thereof, whereas an excessively high twist could result in an overtight yarn having raised stiffness and, therefore, increased heat conductivity, decreased bulk and inadequate sorption properties. Hence, the proposed chemical wool-like filament yarn must have a twist lying within the proposed limits.

BRIEF DESCRIPTION OF THE DRAWINGS

Given below is a detailed description of the present invention with reference to the accompanying drawings, wherein.

DETAILED DESCRIPTION OF THE INVENTION

The wool-like filament is formed from any synthetic fibre-forming thermoplastic polymer such as polyamide, polyester, etc. Consider now the process of filament formation from polycaproamide.

Figure 1:
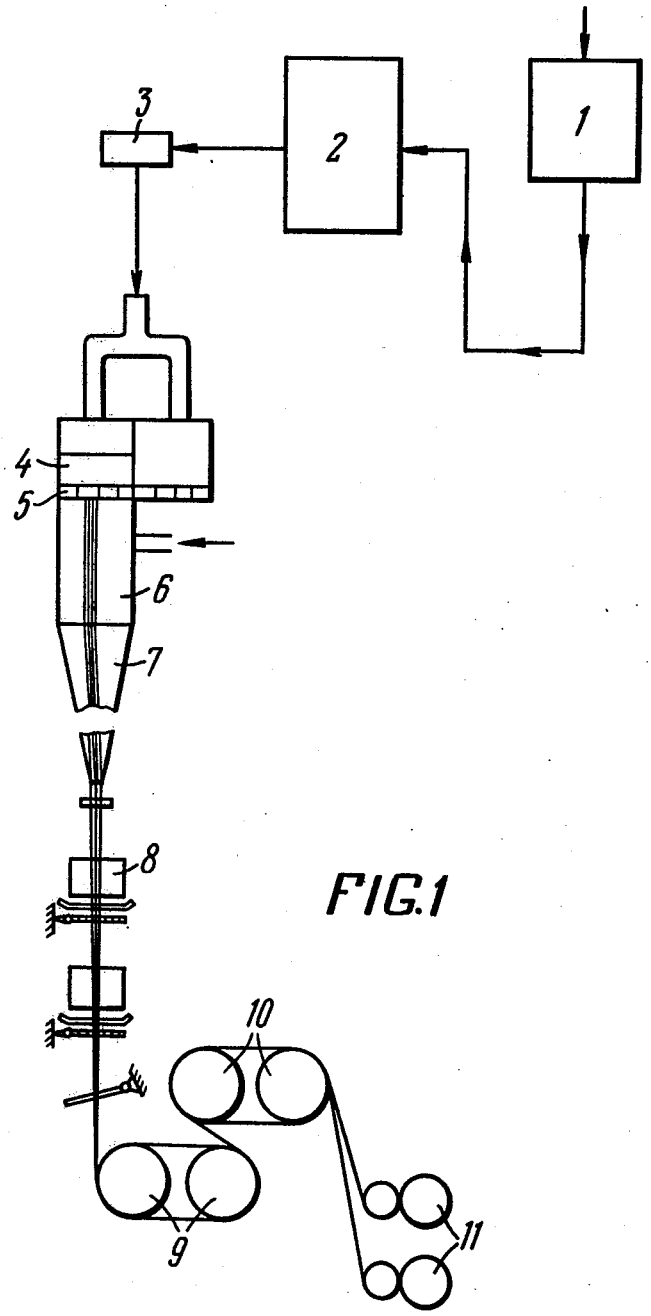
FIG. 1 shows schematically an apparatus for forming wool-like polycaproamide filaments with the use of the proposed spinneret.

The molten polymer is admitted into an apparatus 1 (FIG. 1) for continuous polymerization, then into an apparatus 2 for withdrawing the monomer. The molten polymer having a temperature of 250° to 270° C., a relative viscosity of 2.2 to 2.8 and a content of low-molecular compounds of no more than 3.0 to 3.5% is forced, at a pressure of 60 to 100 kgf/cm$^2$ by means of a screw conveyor 3 to metering pumps 4. To prevent oxidation of the polymer, the process in its entirety takes place in the flow of nitrogen.

The metering pump forces the polymer through a filter and a spinneret 5. The jets of polymer emerging from the spinneret holes pass through cooling and spinning chambers 6 and 7 and under the effect of the cooling air solidify into filaments. The cooling air is admitted into the upper compartment of the cooling chamber 6 at a right angle to the movement of the filament. The temperature of the cooling air is 17° to 25° C., its velocity being 20 to 30 cm/s. The rate of forming is 2,500 to 3,500 m/min. The filaments, while contacting preparation discs 8, pass to first draw-off godets 9 and then to succeeding stretch godets 10 heated to 150°–200° C. The draw ratio lies between 2.5 and 4.0. The formed filament from the second stretch godets is wound onto a bobbin 11 weighing about 5 kg. The ambient conditions in the winding zone shall be maintained constant:

temperature, 20°±2° C.

specific humidity, 48±2%

Given below are examples of producing specific types of filaments from the same polymer with the use of spinnerets embodying the invention.

EXAMPLE 1

Figure 2:
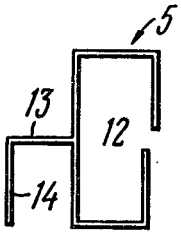
FIGS. 2, 4, 6, 8, 10, 12, 14 show embodiments of configurations of the cross-sections of filament-forming holes, enlarged view.

Formation of the wool-like polycaproamide filament is accomplished, as described above, through the spinneret 5 with the cross-sectional configuration of the filament-forming holes as shown in FIG. 2. The configuration of the slot representing the filament-forming hole is an open tetragon (12), with one of its sides, which is opposite the open one, adjoined, approximately in the mid-point thereof at a right angle thereto, by a first rectilinear portion (13). Adjoining the latter at a right angle thereto is one more rectilinear section (14).

As a result of formation of the filament through the spinneret with the spinning holes of such a configuration with an open tetragon, there is obtained an inner cavity extending over the whole length of the filament. For the open contour to become continuous in the process of forming, the size of the gap should constitute, approximately, from 1 to 5 slot widths.

To ensure a required size of the inner cavity, i.e., to obtain the desirable thermal insulation properties of the filament, the lengths of the tetragon sides should range from 0.5 to 1, with the sides being 0.3 to 1.5 mm long.

The mutually perpendicular portions (13) and (14) form, together with a tetragon side, an open capillary channel communicating with the outer surface of the filament over its entire length. To obtain deep open capillary channels, i.e., to ensure desirable hygienic properties, the length of the rectilinear portions 13 and 14 should range from 0.5 to 1.5 mm. The ratio of the length of the rectilinear portions to the slot width is from 3 to 9, the slot being 0.04 to 0.12 mm wide. Formation of the filament through the spinneret having said configuration of the holes is carried out from the molten polymer with a relative viscosity of 2.2 and a temperature of 260° C. The cooling air temperature is 18° C., its velocity being 20 cm/s. The rate of forming is 3,000 m/min; the draw ratio is 3.5. The second stretch godets are heated to 100° C.

Figure 3:
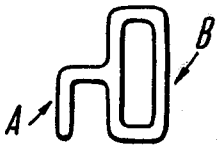
FIGS. 3, 5, 7, 9, 11, 13, 15 show, respectively, embodiments of cross-sectional configurations of the wool-like filaments, enlarged view.

As a result of formation of the filament through the spinneret with said configuration of the filament-forming hole, there is produced a filament having the cross-section, as is shown in FIG. 3, composed of two elements "A" and "B", the element "A" being L-shaped or T-shaped, the other element "B" being shaped as a ring, both the elements forming together deep open capillary channels communicating with the outer surface of the filament over the entire length thereof.

The presence of capillary channels increases the moisture conductivity of the filament, capillarity and moisture capacity ensuring adequate hygienic properties of articles made from these filament yarns. The inner cavity contributes to low heat conductivity of the filament.

With such a shape of the cross-section of the filament, said elements "A" and "B" are cooled at different rates due to their different specific surfaces (per unit of the dope mass). The cooling of the ring-shaped element "B" having an inner cavity is slower. This is conditioned by the presence of air (i.e., thermally non-conductive medium) in the latter and also by that the element has the shape of a ring due to which the cooling occurs only from the outer surface. The element "A" of the open contour composed of the rectilinear branches is cooled from both the outer and inner surfaces. Therefore, its cooling proceeds at a higher rate. Due to such a non-uniformity of cooling of the filament, permanent crimp appears in the filament reminiscent of that of natural wool.

The inner cavity and capillary channels in the filament ensure adequate thermal and sorption properties thereof, the permanent crimp making the filament properties approximate those of the natural wool.

For mechanical and physical characteristics, sorption and thermal properties of the formed wool-like filaments refer to Table 1, column 1.

EXAMPLE 2

Figure 4:
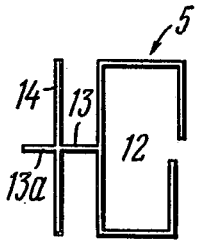

Formation of the wool-like polycaproamide filament is accomplished, as described above, through the spinneret 5, the cross-section of one of the filament-forming holes thereof being illustrated in FIG. 4.

The configuration of the slot of the filament-forming hole of the spinneret represents an open tetragon 12 adjoining one of the sides whereof, i.e., the side opposite the open one, approximately in the mid-point thereof and at a right angle thereto, is the first rectilinear portion 13. This portion 13 is intersected approximately in the middle by a perpendicular section 14, whereby a cross-shaped element is formed. Therewith, the portion 13 adjoins, with its one end, the tetragon 12, the other end 13*a* being free. With the filament being formed through the spinneret with the spinning holes of such a configuration, the open tetragon 12 provides for an inner cavity in the filament extending along the entire length thereof. For the open contour to become continuous in the process of formation, the gap should constitute approximately from 1 to 5 slot widths. To obtain a desired size of the inner cavity, i.e., to provide for required thermal insulation properties of the filament, the ratio of the lengths of the sides of the tetragon 12 should range from 0.5 to 1, the sides being from 0.3 to 1.5 mm long. The ratio of the length of the rectilinear sections to the width of the slot is from 3 to 9, with the slot being 0.04 to 0.12 mm wide.

Figure 5:
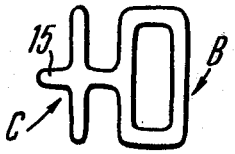

The cross-shaped element of the cross-sectional configuration provides for open capillary channels in the fibre. To ensure a required depth of the open capillary channels, i.e., to ensure necessary sorption properties, the length of the rectilinear portions (13) and (14) should range from 0.5 to 1.5 mm. Formation of the filament through the spinneret with such a configuration of the holes is carried out from molten polycaproamide having a relative viscosity of 2.4 and a temperature of 262° C. The temperature of the cooling air is 20° C., and the air feed velocity is 23 m/s. The rate of forming is 2,800 m/s; the draw ratio is 3.0. The temperature of the second stretch godets is 80° C. The cross-section of the filament is shown in FIG. 5. As a result of formation of the filament through the spinneret with such a configuration of the filament-forming hole, there may be obtained a filament with a cross-section composed of two elements, one of which, element "C", is cross-shaped, and the other element, "B", is shaped as a ring. Such a configuration of the cross-section provides for two deep open capillary channels ensuring adequate sorption properties of the filament, low heat conductivity and permanent crimp. Besides, the branch 15 in the shape of the filament cross-section formed by the free end 13*a* of the rectilinear portion 13 makes it possible to impart to the filament yarn composed of filaments of the given cross-sectional configuration increased bulk attained due to the greater interfilament spacing.

The physical and mechanical characteristics, sorption and thermal insulation properties of the formed wool-like filaments are indicated in Table 1, column 2.

EXAMPLE 3

Figure 6:
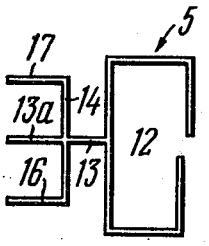

The polycaproamide wool-like filament is formed as described above through the spinneret 5 with the cross-section of one of the filament-forming holes as illustrated in FIG. 6. FIG. 6 shows the shape of the slot of the filament-forming hole, similar to that shown in FIG. 4, wherein adjoining the rectilinear section 14, at a right angle thereto and as close as possible to the ends thereof, are a second and third rectilinear portions 16 and 17 approximately equal in length and directed aside from the tetragon (12), whereby an element is formed shaped as a three-pronged fork. During formation of the filament, the open tetragon 12 ensures provision of an inner cavity as described above, whereas the element shaped as a three-pronged fork ensures sufficiently large and deep capillary channels, which is attainable with the size of the rectilinear portions 16 and 17 ranging from 0.25 to 0.60 mm.

Formation of the filament through the spinneret with such a configuration of the holes is accomplished from molten polycaproamide having a relative viscosity of 2.6 and a temperature of 265° C. The temperature of the cooling air is 23° C., the air feed velocity being 25 m/s. The rate of forming is 2700 m/min, and the draw ratio is 2.8. The second stretch godets are heated to 90° C.

Figure 7:
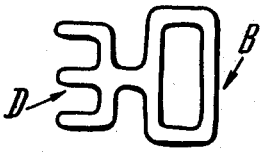

As a result of formation of the filament through the spinneret with said filament-forming hole, there is obtained a filament with the configuration of its cross-section as shown in FIG. 7, composed of two elements "B" and "D". One of these elements, the element "D" is shaped as a three-pronged fork and the other, the element "B", is shaped as a ring. The presence in the configuration of the filament cross-section of the element "D" shaped as a three-pronged fork enables an increase in the moisture conductivity and capillarity of the filament due to the greater number of capillary channels and due to formation of two additional deep open capillary channels, four all in all. Besides, the element shaped as a three-pronged fork further increases the bulk of the filament yarn composed of filaments with the above configuration of the cross-section due to greater interfilament distances. The physical and mechanical properties of the formed filament are indicated in Table 1, column 3.

EXAMPLE 4

Figure 8:
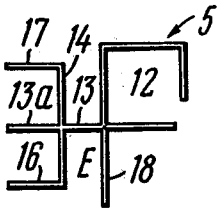

Formation of the polycaproamide wool-like filament is accomplished, as described above, through the spinneret 5 with the cross-section of one of the filament-forming holes as shown in FIG. 8.

The configuration of the filament-forming hole in the spinneret represents a tetragon 12 open at one of its vertices, the rectilinear portion 13 of the element shaped as a three-pronged fork similar to that shown in FIG. 6, adjoining the vertex "E" of the tetragon. Emerging from the same vertex "E" of the tetragon 12 is one more, fourth rectilinear portion 18 perpendicular to the first portion 13. The open tetragon with a gap equalling approximately 1 to 5 widths of the slot has a ratio of the lengths of the short and long sides ranging from 0.6 to 1.0, the sides of the polygon being approximately two times shorter as compared with the polygon in the holes shown in FIGS. 2, 4 and 6. The ratio of the lengths of the portions 13, 14 and 18 to the length of the side of the tetragon 12 adjoined by the three-pronged fork is, respectively, 1 to 1.4, 1.2 to 1.8 and 0.5 to 0.9.

Formation of the filament through the spinneret with such a configuration of the holes is accomplished from molten polycaproamide having a relative viscosity of 2.65 and a temperature of 267° C. The temperature of the cooling air is 24° C., the air being fed at 27 m/s. The rate of forming is 2,900 m/min, the draw ratio is 2.9, with the temperature of the second stretch godets being equal to 110° C.

Figure 9:
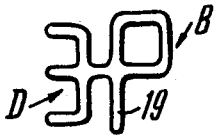

As a result of formation of the filament through such a filament-forming hole in the spinneret, there is obtained a filament with the configuration of the cross-section as shown in FIG. 9, composed of the following elements: the element "D" shaped as a three-pronged fork, an additional branch 19 formed by the additional rectilinear portion 18 emerging from the vertex "E" of the tetragon 12, and the ring-shaped element "B". In this case, as distinct from the above-considered cross-sections of the filament, the ring-shaped element "B" is approximately twice as small.

Besides, the ring-shaped element "B" in the cross-section of the filament occupies the right upper corner relative to the axis of symmetry of the contour. The three-pronged element "D", along with the additional rectilinear branch 19 and the ring-shaped element "B", form four deep open capillary channels. In addition, intermediate of the additional branch 19 and the ring-shaped element "B" in the cross-section, there if formed one more less deep capillary channel. The presence of the latter improves the sorption properties of the filament. The smaller size of the cavity and the circumferential arrangement thereof with respect to the axis of symmetry of the configuration of the cross-section change the filament cooling conditions and ensure fine crimp of the filament, which is desirable for the production of a filament yarn of low linear density suitable for manufacture of light fabric of adequate hygienic properties to be used in hot and humid climates.

The physical and mechanical properties of the formed filament are indicated in Table 1, column 4.

EXAMPLE 5

Figure 10:
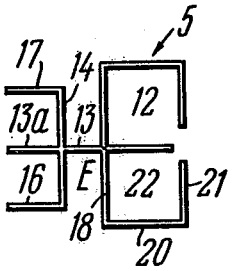

Formation of the polycaproamide wool-like filament is carried out, as described above, through the spinneret 5 with the cross-section of one of the filament-forming holes as shown in FIG. 10.

The configuration of the filament-forming hole in the spinneret is similar to that shown in FIG. 8. Adjoining the fourth rectilinear portion 18, at a right angle thereto, is a fifth rectilinear portion 20. Arranged at the free end of the fifth rectilinear portion 20, at a right angle thereto, is another, sixth rectilinear portion 21 directed to the tetragon 12, whereby there is formed an additional open polygon 22 approximately equal in size to the polygon 12. The ratio of the lengths of the portions 20 and 21 to the length of the portion 18 is 1.1 to 1.3 and 0.5 to 0.8. The sides of the polygon 22 are approximately two times shorter than the sides of the tetragon 12, as shown in FIGS. 2, 4 and 6.

Formation of the filament through the spinneret with such a configuration of the holes is performed from molten polycaproamide having a relative viscosity of 2.64 and a temperature of 268° C. The temperature of the cooling air is 19° C., the air is fed at a rate of 28 m/s. The rate of forming is 3,100 m/min, the draw ratio is 2.5, the temperature of the second stretch godets being 125° C.

Figure 11:
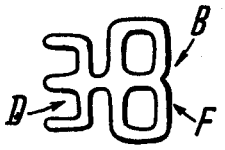

As a result of formation of the filament through such a hole in the spinneret, the obtained filament has, as is shown in FIG. 11, two closed ring-shaped elements "B" and "F" which form two small cavities in the filament, and the three-pronged element "D" which forms in the filament four deep open capillary channels. The produced filament yarn features high stiffness and resilience. The filament yarn composed of filaments with the given cross-sectional shape may be used for the production of pile fabrics with pile resistant to mechanical action. The physical and mechanical properties of the formed filament are indicated in Table 1, column 5.

EXAMPLE 6

Figure 12:
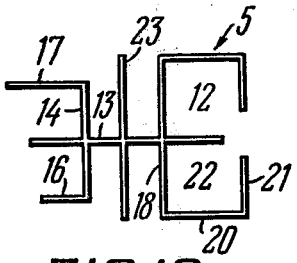

Formation of the polycaproamide wool-like filament is carried out, as described above, through the spinneret 5 with the cross-section of one of the filament-forming holes as shown in FIG. 12.

The configuration of the filament-forming hole is similar to that shown in FIG. 10. The rectilinear portion 13 with which the three-pronged fork adjoins the tetragon 12 is intersected approximately in the middle by a perpendicular seventh portion 23. The ratio of the length of the portion 23 to the length of the portion 13 is 1.3 to 2.

Formation of the filament through the spinneret with such a configuration of the holes is performed from molten polycaproamide having a relative viscosity of 2.68 and a temperature of 270° C. The temperature of the cooling air is 19° C., the air feed velocity being 29 m/s. The rate of forming is 3,200 m/min, the draw ratio is 2.55, and the temperature of the second stretch godets is 135° C.

Figure 13:
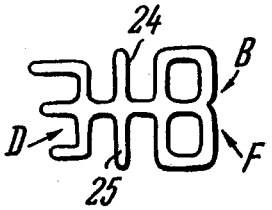

As a result of formation through such a hole, the filament cross-section, as is shown in FIG. 13, is composed of the following elements: two ring-shaped elements "B" and "F", the element "D" shaped as a three-pronged fork and two additional rectilinear branches 24 and 25. Two ring-shaped elements "B" and "F" form two cavities in the filament, identical in size with those formed in the filament whose cross-section is shown in FIGS. 11 and 9. The element "D" shaped as a three-pronged fork and two additional branches 24 and 25, together with the ring-shaped elements, form six deep open capillary channels. Besides, the two additional branches 24 and 25 equalize the masses of two portions of the filament cross-section, one of which includes the element "D" shaped as a three-pronged fork and two additional rectilinear branches 24 and 25 and the other, two ring-shaped elements "B" and "F".

This decreases somewhat the filament crimp. However, due to the increased number of the deep open capillary channels, the sorption properties are markedly improved. The latter ensures adequate ventilation of the space between the human body and the garment. The physical and mechanical properties of the formed filament are indicated in Table 1, column 6.

EXAMPLE 7

Figure 14:
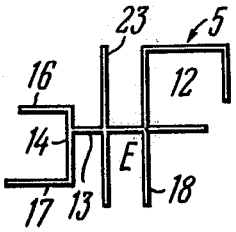

Formation of the polycaproamide wool-like filament is accomplished, as described above, through the spinneret 5 with the cross-section of one of the filament-forming holes as shown in FIG. 14. The configuration of the filament-forming hole in the spinneret represents an open tetragon 12 identical with that shown in FIG. 8. Adjoining one of the vertices "E" of this tetragon is an element shaped as a two-pronged fork formed by the portions 13, 16, 17 and 14.

Emerging from the same vertex "E" of the tetragon 12 is a fourth rectilinear portion 18 perpendicular to said first portion 13 which is intersected roughly in the middle and at a right angle by the rectilinear portion 23. Therewith, the sizes of said portions and the ratios thereof are similar to the sizes of the like portions in the cross-sections shown in FIGS. 8, 10, 12. Formation of the filament through the spinneret with such a configuration of the holes is performed from molten polycaproamide having a relative viscosity of 2.72 and the temperature of 275° C. The temperature of the cooling air is 19° C., the air feed velocity is 33 m/s. The rate of forming is 3,500 m/min, the draw ratio is 2.6 and the temperature of the second stretch godets is 150° C.

Figure 15:
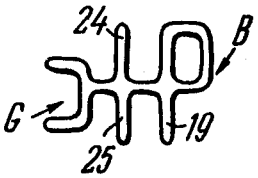

As a result of formation through such a hole, the cross-section of the filament, as is shown in FIG. 15, is composed of: an element "G" shaped as a two-pronged fork, three rectilinear branches 24, 25 and 19, and a ring-shaped element "B". The ring-shaped element "B" forms in the filament a cavity similar in size to that in the filament whose cross-section is shown in FIG. 9 and which is arranged circumferentially relative to the axis of symmetry of the contour. At the same time, the rectilinear branches 24, 25, 19 and the element shaped as a two-pronged fork form, together and along with the ring-shaped element, five deep open capillary channels and one less deep capillary channel formed by the branch 19 along with the element "B".

Due to the plurality of capillary channels and also due to the small cavity, such a filament features high sorption properties and fine crimp and may be used in light fabrics and knitwear suitable for hot and humid climates.

As is seen from Table 1, the filament yarn composed of filaments obtained on the spinneret with the proposed shapes of the spinning holes possesses all wool-like properties, namely, low heat conductivity, permanent crimp and high hygienic properties.

Table 1

| Characteristics | 1 | 2 | 3 | 4 | 5 | 6 | 7 | Caprone filamentary yarn | Wool yarn |
|---|---|---|---|---|---|---|---|---|---|
| 1. Linear density, tex | 15.7 | 15.7 | 15.7 | 15.7 | 15.7 | 15.7 | 15.7 | 15.6 | 17.8 |
| 2. Number of filaments in the filament yarn | 45 | 45 | 45 | 45 | 45 | 45 | 45 | 45 | |
| 3. Relative strength, N/tex | 0.40 | 0.41 | 0.39 | 0.43 | 0.42 | 0.43 | 0.42 | 0.41 | 0.26 |
| 4. Relative breaking elongation, % | 26.3 | 26.7 | 26.8 | 26.7 | 27.9 | 27.1 | 25.7 | 28.2 | 14.4 |
| 5. Sorption properties: | | | | | | | | | |
| -capillarity, mm | 54 | 57 | 60 | 64 | 59 | 70 | 66 | 28 | 25 |
| -moisture absorption, % | 74 | 76 | 84 | 90 | 85 | 96 | 93 | 42 | 96 |
| -moisture desorption, % | 30 | 34 | 39 | 44 | 40 | 45 | 45 | | 18 |
| 6. Conductivity factor, W/m . °K. | 0.040 | 0.040 | 0.038 | 0.042 | 0.041 | 0.038 | 0.043 | 0.049 | 0.040 |
| 7. Crimp | | | | | | | | | |
| -crimps per cm | 2–5 | 2–6 | 2–8 | 2–10 | 2–7 | 2–8 | 2–10 | no crimp | 5–12 |
| 8. Unity of modulus, Pa | $2.0 \cdot 10^7$ | $2.2 \cdot 10^7$ | $2.1 \cdot 10^7$ | $2.4 \cdot 10^7$ | $2.3 \cdot 10^7$ | $2.2 \cdot 10^7$ | $2.4 \cdot 10^7$ | $2.1 \cdot 10^7$ | $0.76–10^7$ |
| 9. Stiffness in twisting, rel. units | 118 | 119 | 122 | 123 | 125 | 124 | 123 | 109 | 92 |
| 10. Complete deformation, % | 4.8 | 5.3 | 6.2 | 4.9 | 6.4 | 5.7 | 5.9 | 5.5 | 2.2 |
| 11. Component recovered deformation | 0.92 | 0.93 | 0.93 | 0.95 | 0.97 | 0.95 | 0.98 | 0.97 | 0.69 |
| 12. Specific strength, % | | | | | | | | | |
| -knot strength | 97 | 99 | 98 | 98 | 97 | 93 | 96 | 98 | 96 |
| -loop break strength | 99 | 99 | 97 | 99 | 98 | 94 | 97 | 95 | 87 |
| 13. Fatigue life, thousands of cycles | >30 | >30 | >30 | >30 | >30 | >30 | >30 | >30 | 0.25 |
| 14. Double flexing life, thousands of cycles | >50 | >50 | >50 | >50 | >50 | >50 | >50 | >50 | 25.2 |
| 15. Resistance to abrasion, thousands of cycles | 43 | 48 | 51 | 59 | 47 | 52 | 55 | 48 | 1.9 |
| 16. Boiling water shrinkage, % | 14.8 | 14.7 | 13.8 | 15.5 | 15.6 | 14.9 | 15.1 | 11.2 | 5.4 |

EXAMPLE 8

The filament yarn composed of filaments formed on the spinneret with the proposed spinning holes is subjected to twisting ranging from 10 to 1,500 T.P.M. Said twist is imparted to the filament yarn with the aim of improving the wool-like properties of the yarn and the textile product therefrom.

An excessively high twist results in an overtight yarn possessing increased heat conductivity, the decreased bulk of the yarn resulting in increased stiffness thereof.

Too low a twist impairs the sorption properties of the yarn and the product therefrom.

The physical and mechanical properties of the filament wool-like yarn with various amounts of twist applied thereto are given in Table 2.

Table 2

| Characteristics | Samples 1 | 2 | 3 | 4 |
|---|---|---|---|---|
| 1. Twist range, T.P.M. | 10 | 500 | 1000 | 1500 |
| 2. Relative strength, N/tex | 0.43 | 0.45 | 0.44 | 0.39 |
| 3. Breaking elongation, % | 26.7 | 28.6 | 29.3 | 33.1 |
| 4. Complete deformation, % | 5.1 | 5.8 | 6.7 | 7.2 |
| 5. Component recovered deformation | 0.92 | 0.94 | 0.97 | 0.97 |
| 6. Stiffness in twisting, rel, units | 101 | 110 | 111 | 118 |
| 7. Static electricity, C/m | 11.6 × 10–10 | 11.4 × 10–10 | 10.3 × × 10–10 | 10.5 × 10– –10 |
| 8. Conductivity factor, W/m . °K. | 0.042 | 0.045 | 0.049 | 0.050 |
| 9. Capillarity, mm | 56 | 58 | 60 | 63 |
| 10. Diameter, mm | 0.35 | 0.29 | 0.26 | 0.23 |

What is claimed is:

1. A spinneret for obtaining a chemical filament having a cross-section defining a first ring shaped portion and a second rectilinearly shaped portion integral therewith, comprising: a dope spinning hole shaped as a slot, the configuration of the slot defining an open polygon comprising means for forming said first ring shaped portion of said filament; means defining a first rectilinear portion adjoining at least one of the sides of the polygon at a right angle thereto; means defining at least one more slot shaped as a rectilinear section intersecting said first rectilinear portion at a right angle thereto, whereby a cross-shaped slot is formed by the first rectilinear portion and the rectilinear section.

2. A spinneret for obtaining a chemical filament having a cross-section defining a first ring shaped portion and a second rectilinearly shaped portion integral therewith, comprising: a dope spinning hole shaped as a slot, the configuration of the slot defining an open polygon comprising means for forming said first ring shaped portion of said filament; means defining a first rectilinear portion adjoining at least one of the sides of the polygon at a right angle thereto; means defining at least one more slot shaped as a rectilinear section intersecting said first rectilinear portion a right angle thereto, where by a cross-shape slot is formed by the first rectilinear portion and the rectilinear section; and means defining second and third rectilinear portions adjoining said rectilinear section at right angles thereto and as close as possible to the ends thereof.

3. A spinneret as claimed in claim 2, wherein said second and third rectilinear portions are directed aside from the polygon, thereby forming, together with the first rectilinear portion, a slot having the configuration of a three-pronged fork.

4. A spinneret as claimed in claim 3, wherein the slot shaped as a three-pronged fork adjoins, with the first rectilinear portion, one of the vertices of the open polygon, and further including means defining a fourth rectilinear portion emerging from this vertex at a right angle to said first rectilinear portion.

5. A spinneret as claimed in claim 4, wherein adjoining the fourth rectilinear portion at a right angle thereto is a fifth rectilinear portion, having means defining a free end and further including means defining a sixth rectilinear portion extending from said free end of said fifth rectilinear portion and directed towards the polygon, whereby an additional open polygon is formed.

6. A spinneret as claimed in claim 5, wherein a section of the first rectilinear portion, arranged intermediate of the rectilinear section and the fourth rectilinear portion is intersected at a right angle, at the substantial mid-portion thereby by means defining a seventh rectilinear portion.

7. A spinneret as claimed in claim 6, wherein the rectilinear section and the first, second and third rectilinear portions are mutually arranged so that they form a two-pronged for adjoining, with the first rectilinear portion, a vertex of the polygon, the first rectilinear portion being intersected at the substantial mid-portion thereof and at a right angle by the seventh rectilinear portion.

* * * * *